US011332843B2

(12) United States Patent
Yamasaki

(10) Patent No.: US 11,332,843 B2
(45) Date of Patent: May 17, 2022

(54) ANODE ASSEMBLY

(71) Applicant: EBARA CORPORATION, Tokyo (JP)

(72) Inventor: Gaku Yamasaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/066,859

(22) Filed: Oct. 9, 2020

(65) Prior Publication Data

US 2021/0130977 A1 May 6, 2021

(30) Foreign Application Priority Data

Oct. 30, 2019 (JP) ..... JP2019-197440

(51) Int. Cl.
*C25D 17/12* (2006.01)
*C25D 17/06* (2006.01)
*C25D 17/04* (2006.01)

(52) U.S. Cl.
CPC ..... *C25D 17/12* (2013.01); *C25D 17/04* (2013.01); *C25D 17/06* (2013.01)

(58) Field of Classification Search
None
See application file for complete search history.

(56) References Cited

U.S. PATENT DOCUMENTS 4,964,964 A * 10/1990 Murphy ..... C25D 17/00 204/224 R
9,017,528 B2 * 4/2015 Papapanayiotou .... C25D 21/10 204/237
10,100,424 B2 * 10/2018 Fujikata ..... C25D 21/12
2006/0237304 A1 * 10/2006 Yamamoto ..... C25D 17/001 204/242
2016/0369421 A1 * 12/2016 Yahagi ..... C25D 17/04

FOREIGN PATENT DOCUMENTS

JP 2009-046724 A 3/2009
JP 2015-151553 A 8/2015

* cited by examiner

*Primary Examiner* — Stefanie S Wittenberg
(74) *Attorney, Agent, or Firm* — BakerHostetler

(57) ABSTRACT

An anode assembly allowing the anode to be easily pulled up from a plating tank is disclosed. The anode assembly includes: an anode structure; and an anode holder. The anode structure includes: an anode; and a feeding member. The anode holder includes: an anode support frame having a space in which the anode structure is arranged; a conductive bar; and a feeding electrode attached to an end of the conductive bar. One end of the feeding member is fixed to the anode, and the other end of the feeding member is detachably fixed to the conductive bar. The anode support frame has a positioning guide portion into which a lower end of the anode structure is inserted. The anode assembly is configured to allow the anode structure to be separated from the anode holder and pulled up from the plating tank when the feeding member is detached from the conductive bar.

8 Claims, 13 Drawing Sheets

ANODE ASSEMBLY

CROSS REFERENCE TO RELATED APPLICATION

This document claims priority to Japanese Patent Application Number 2019-197440 filed Oct. 30, 2019, the entire contents of which are hereby incorporated by reference.

BACKGROUND

An electroplating apparatus, which is an example of a plating apparatus, is configured to immerse a workpiece (for example, a square substrate, a wafer, etc.) held by a workpiece holder in a plating solution, and apply a voltage between the workpiece and an anode to deposit a metal film on a surface of the workpiece. The electroplating apparatus is constituted such that the anode held by an anode holder and the workpiece held by the workpiece holder are arranged in parallel in a plating tank holding a plating-solution so as to face each other, and electroplating is performed on an exposed surface, to be plated, of the workpiece held by the workpiece holder by energizing the anode and the workpiece by a plating power supply. In such electroplating apparatus, the anode deteriorates gradually with use thereof, and therefore the anode need to be removed from the plating tank and replaced periodically.

Conventionally, in order to remove the anode from the plating tank and replace it, the entire anode holder had to be pulled up from the plating tank. After the anode holder was pulled up from the plating tank, the anode holder was disassembled outside the plating tank, and a used anode was taken out from the anode holder and replaced with a new anode.

However, recently, a workpiece as an object to be plated tends to become large, and accordingly, the anode and the anode holder for holding the anode also become large. As the anode holder becomes large, a weight of the anode holder increases, and it becomes difficult to pull up the entire anode holder from the plating tank.

SUMMARY OF THE INVENTION

Therefore, there is provided an anode assembly including an anode and an anode holder for holding the anode, and allowing the anode to be easily pulled up from a plating tank.

Embodiments, which will be described below, relate to an anode assembly used in a plating apparatus for plating a workpiece, such as a square substrate, a wafer, and a panel.

In an embodiment, there is provided an anode assembly configured to be vertically positioned in a plating tank, comprising: an anode structure; and an anode holder configured to hold the anode structure, wherein the anode structure includes: an anode; and a feeding member extending upward from the anode, the anode holder includes: an anode support frame having a space in which the anode structure is arranged; a conductive bar fixed to an upper end of the anode support frame and extending laterally from the anode support frame; and a feeding electrode attached to an end of the conductive bar, one end of the feeding member is fixed to the anode, and the other end of the feeding member is detachably fixed to the conductive bar, the anode support frame has a positioning guide portion into which a lower end of the anode structure is inserted, and the anode structure is configured to be able to be separated from the anode holder and be pulled up from the plating tank when the feeding member is detached from the conductive bar.

In an embodiment, the anode support frame includes a side guide portion extending along a side of the anode structure.

In an embodiment, the anode support frame is made of insulating material.

In an embodiment, the positioning guide portion has a tapered surface inclined obliquely downward toward a front of the anode support frame.

In an embodiment, the anode structure further includes an anode cartridge configured to cover a back surface of the anode and support the anode.

In an embodiment, the anode cartridge is made of insulating material.

In an embodiment, the anode holder further includes a mask fixed to the anode support frame, and the mask has an opening located in front of the anode.

According to the above-described embodiments, with the anode holder installed in the plating tank, the anode structure can be separated from the anode holder and pulled up from the plating tank. Therefore, the anode can be easily pulled up from the plating tank.

DESCRIPTION OF EMBODIMENTS

Figure 1:
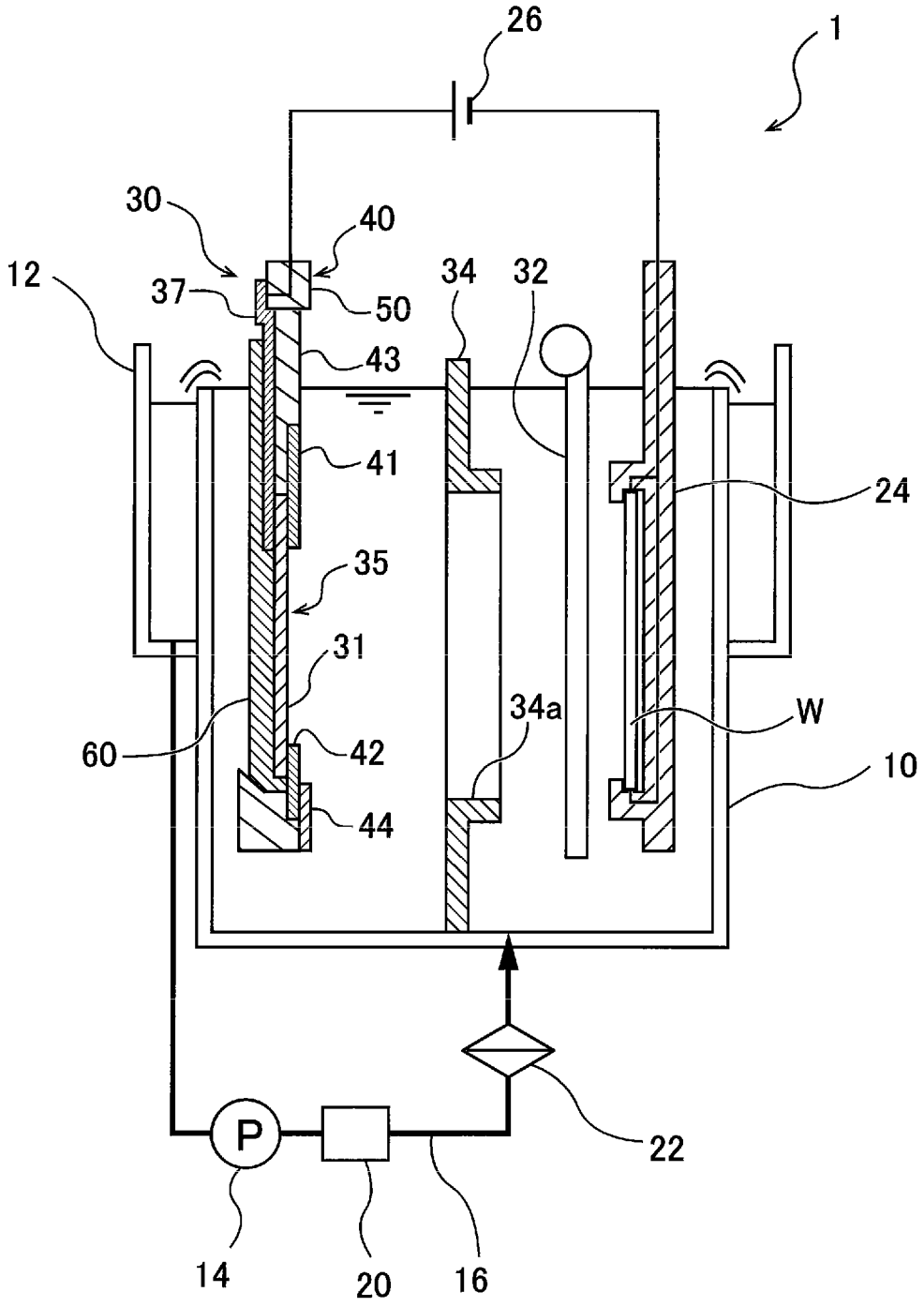
FIG. 1 is a vertical cross-sectional front view showing an embodiment of an electroplating apparatus.

Embodiments will now be described with reference to the drawings. FIG. 1 is a vertical cross-sectional front view showing an embodiment of an electroplating apparatus. As shown in FIG. 1, an electroplating apparatus 1 includes a plating tank 10. A plating solution is held in the plating tank 10. An overflow tank 12 for receiving the plating solution that has overflowed a top edge of the plating tank 10 is provided adjacent to the plating tank 10.

One end of a plating-solution circulation line 16, which is provided with a pump 14, is coupled to a bottom of the overflow tank 12, while other end of the plating-solution circulation line 16 is coupled to a bottom of the plating tank 10. The plating solution that has accumulated in the overflow tank 12 is returned through the plating-solution circulation line 16 to the plating tank 10 by an operation of the pump 14. A temperature-regulating device 20 for regulating a temperature of the plating solution, and a filter 22 for removing foreign matter from the plating solution, both located downstream of the pump 14, are attached to the plating-solution circulation line 16.

The electroplating apparatus 1 includes a workpiece holder 24 which detachably holds a workpiece (an object to be plated) W and immerses the workpiece W in a vertical position in the plating solution held in the plating tank 10. The electroplating apparatus 1 further includes an anode assembly 30 and a plating power supply 26. The workpiece holder 24 and the anode assembly 30 are vertically arranged in the plating tank 10 and face each other. The plating power supply 26 is arranged outside the plating tank 10. A membrane (not shown), such as a neutral diaphragm or an ion-exchange membrane, may be disposed around the anode assembly 30. Examples of the workpiece W as an object to be plated may include a wafer constituting a semiconductor device, a square substrate, a printed-wiring board, and a panel.

The anode assembly 30 includes an anode structure 35 and an anode holder 40 for holding the anode structure 35. The anode structure 35 includes an anode 31, a feeding member 37 extending upward from the anode 31, and an anode cartridge 60 supporting the anode 31. The anode holder 40 includes an anode support frame 43 and a conductive bar 50 fixed to an upper end of the anode support frame 43. One end of the feeding member 37 is fixed to the anode 31, and the other end of the feeding member 37 is detachably fixed to the conductive bar 50. The anode cartridge 60 covers a back surface of the anode 31. The anode 31 of this embodiment is an insoluble anode, while, in one embodiment, the anode 31 may be a soluble anode.

When the workpiece holder 24 holding the workpiece W and the anode assembly 30 are set in the plating tank 10, the workpiece W and the anode 31 face each other in the plating tank 10. The workpiece W has a conductive layer (for example, a seed layer) that has been formed in advance on a surface (surface to be plated) of the workpiece W. The anode 31 is electrically coupled to a positive electrode of the plating power supply 26 through the feeding member 37 and the conductive bar 50. The conductive layer of the workpiece W is coupled to a negative electrode of the plating power supply 26 through the workpiece holder 24. When the plating power supply 26 applies a voltage between the anode 31 and the workpiece W, the workpiece W is plated in the presence of the plating solution. As a result, a metal film (e.g., a copper film) is deposited on the surface of the workpiece W.

The anode holder 40 further includes a mask 41 made of a dielectric material for adjusting an electric field formed between the anode 31 and the workpiece W. The mask 41 is fixed to the anode support frame 43, and the mask 41 is arranged on a front surface (a surface facing the workpiece holder 24) of the anode holder 40. The mask 41 has an opening 42 through which a current flowing between the anode 31 and the workpiece W passes. The opening 42 is located in front of the anode 31. By providing such mask 41, film thicknesses at a center and a periphery of the workpiece W can be adjusted. Therefore, the electroplating apparatus 1 can improve a uniformity of a thickness of the metal film formed on the workpiece W by plating of the workpiece W.

A paddle 32, which is configured to reciprocate parallel to the surface of the workpiece W to agitate the plating solution, is disposed between the workpiece holder 24 and the anode 31. By agitating the plating solution with the paddle 32, a sufficient amount of metal ions can be supplied uniformly to the surface of the workpiece W. Further, a regulation plate 34 made of a dielectric material is disposed between the paddle 32 and the anode 31 for making distribution of electric potential more uniform over the entire surface of the workpiece W.

The regulation plate 34 has an opening 34*a* through which a current flowing between the anode 31 and the workpiece W passes. The regulation plate 34 has a function of adjusting the electric field formed between the anode 31 and the workpiece W. The regulation plate 34 can improve the uniformity of the thickness of the metal film formed on the workpiece W by plating of the workpiece W.

Figure 2:
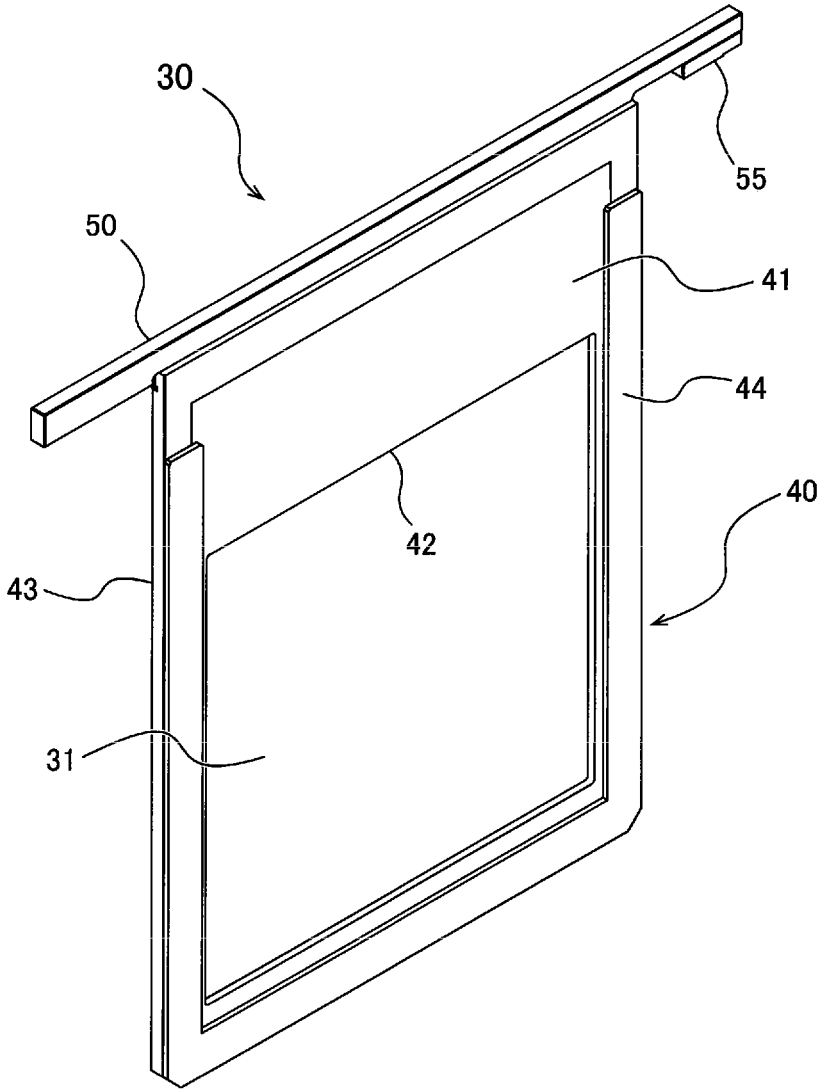
FIG. 2 is a front perspective view of an anode assembly.
Figure 3:
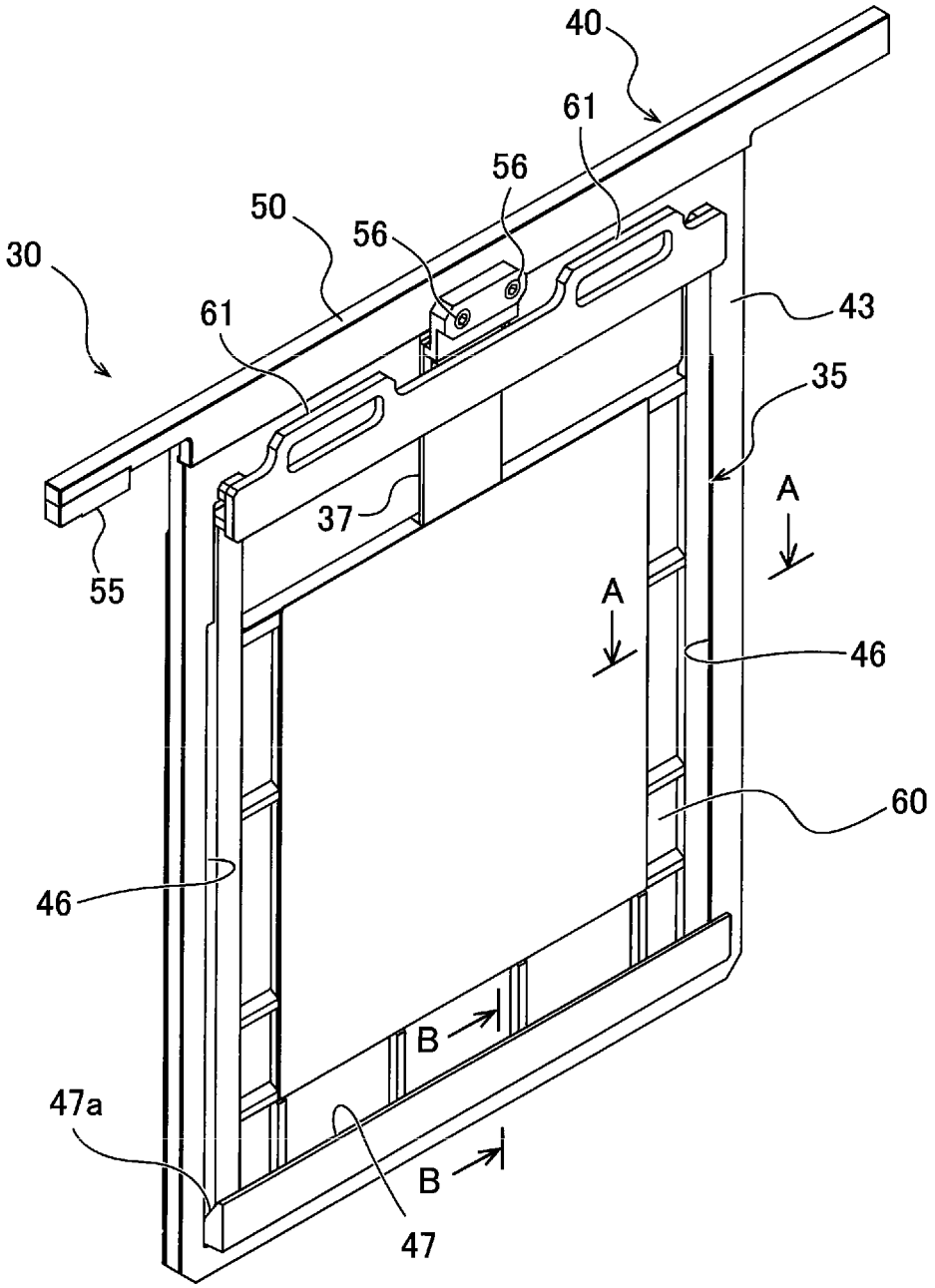
FIG. 3 is a rear perspective view of the anode assembly.
Figure 4:
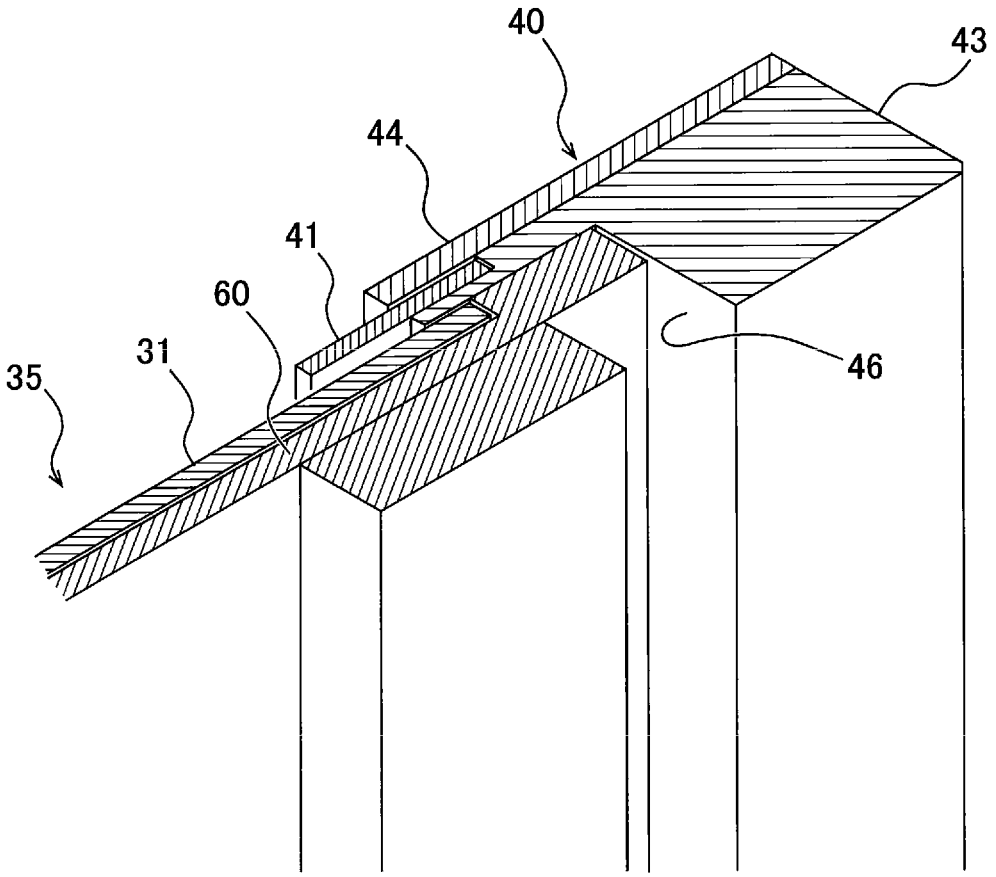
FIG. 4 is a cross-sectional perspective view showing a cross section taken along line A-A shown in FIG. 3.
Figure 5:
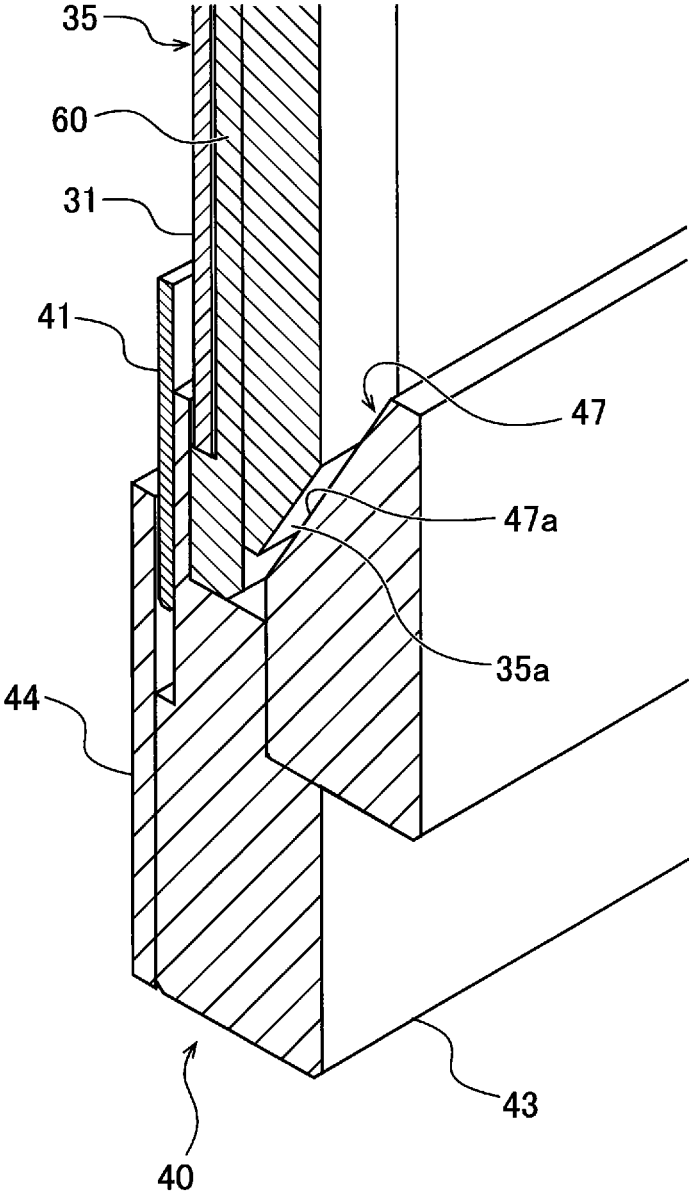
FIG. 5 is a cross-sectional perspective view showing a cross section taken along line B-B shown in FIG. 3.

FIG. 2 is a front perspective view of the anode assembly 30, and FIG. 3 is a rear perspective view of the anode assembly 30. FIG. 4 is a cross-sectional perspective view showing a cross section taken along line A-A shown in FIG. 3, and FIG. 5 is a cross-sectional perspective view showing a cross section taken along line B-B shown in FIG. 3. As described above, the anode structure 35 includes the anode 31, the feeding member 37 extending upward from the anode 31, and the anode cartridge 60 supporting the anode 31. The anode holder 40 includes the anode support frame 43 and the conductive bar 50 fixed to the upper end of the anode support frame 43. In this embodiment, the workpiece W is a square substrate, and the anode 31 has a quadrangular shape similar to the square substrate. In one embodiment, the workpiece W may be a circular wafer, and the anode 31 may be circular.

The anode cartridge 60 and the anode support frame 43 are made of insulating material. An example of the insulating material constituting the anode cartridge 60 and the anode support frame 43 includes vinyl chloride. The feeding member 37 and the conductive bar 50 are made of conducting material, such as a metal. An example of the conducting material constituting the conductive bar 50 includes titanium. The anode cartridge 60 has handles 61 at an upper portion of the anode cartridge 60. In this embodiment, two handles 61 are provided at both sides of the feeding member 37.

The mask 41 is supported by the anode support frame 43. A mask holder 44 for fixing the mask 41 to the anode support frame 43 is fixed to a front surface of the anode support frame 43. The mask holder 44 is located outwardly of the opening 42 of the mask 41 so as not to obstruct an electric field formed by the anode 31 exposed through the opening 42.

As shown in FIGS. 4 and 5, the anode support frame 43 includes side guide portions 46 each for guiding a side of the anode structure 35, and a positioning guide portion 47 into which a lower end of the anode structure 35 is inserted. Specifically, the side guide portions 46 extend along the sides of the anode structure 35, and the positioning guide portion 47 extends along the lower end of the anode structure 35. The positioning guide portion 47 has a tapered surface 47*a* inclined obliquely downward toward the front of the anode support frame 43 (see FIGS. 3 and 5). Further, as shown in FIG. 5, the anode structure 35 has a tapered surface 35*a* at the lower end of the anode structure 35. The tapered surface 35*a* is inclined obliquely upward toward the back side of the anode structure 35. The tapered surface 35*a* has a shape which is in surface contact with the tapered surface 47*a* of the positioning guide portion 47. With such structures of the side guide portions 46 and the positioning guide portion 47, a position of the anode structure 35 relative to the anode holder 40 is fixed, so that the anode structure 35 is stably held by the anode holder 40.

As shown in FIG. 5, the positioning guide portion 47 has a groove shape extending along the lower end of the anode structure 35. The lower end of the anode structure 35 is inserted into the groove-shaped positioning guide portion 47. The tapered surface 35*a* of the anode structure 35 and the tapered surface 47*a* of the positioning guide portion 47 are provided to facilitate insertion of the lower end of the anode structure 35 into the positioning guide portion 47. The tapered surface 35*a* may be omitted as long as the lower end of the anode structure 35 itself has a shape easy to be inserted into the positioning guide portion 47.

As shown in FIGS. 2 and 3, the conductive bar 50 is fixed to the upper end of the anode support frame 43 and extends laterally from the anode support frame 43. The anode holder 40 includes a feeding electrode 55 attached to an end of the conductive bar 50. An electrical contact (not shown) is attached to the plating tank 10, and this electrical contact is coupled to the positive electrode of the plating power supply 26. When the anode assembly 30 is installed in the plating tank 10, the feeding electrode 55 comes into contact with the electrical contact on the plating tank 10. The plating power supply 26 can supply electric power to the anode 31 through the feeding electrode 55, the conductive bar 50, and the feeding member 37.

One end (or a lower end) of the feeding member 37 is fixed to the anode 31. As shown in FIG. 3, other end (or an upper end) of the feeding member 37 is detachably fixed to the conductive bar 50 by a plurality of screws 56 as fasteners. The anode structure 35 is fixed to the anode holder 40 only by the screws 56. Therefore, by removing the screws 56, the feeding member 37 can be detached from the conductive bar 50, and the anode structure 35 can be removed from the anode holder 40. In one embodiment, a single screw 56 may be provided as a fastener.

Figure 6:
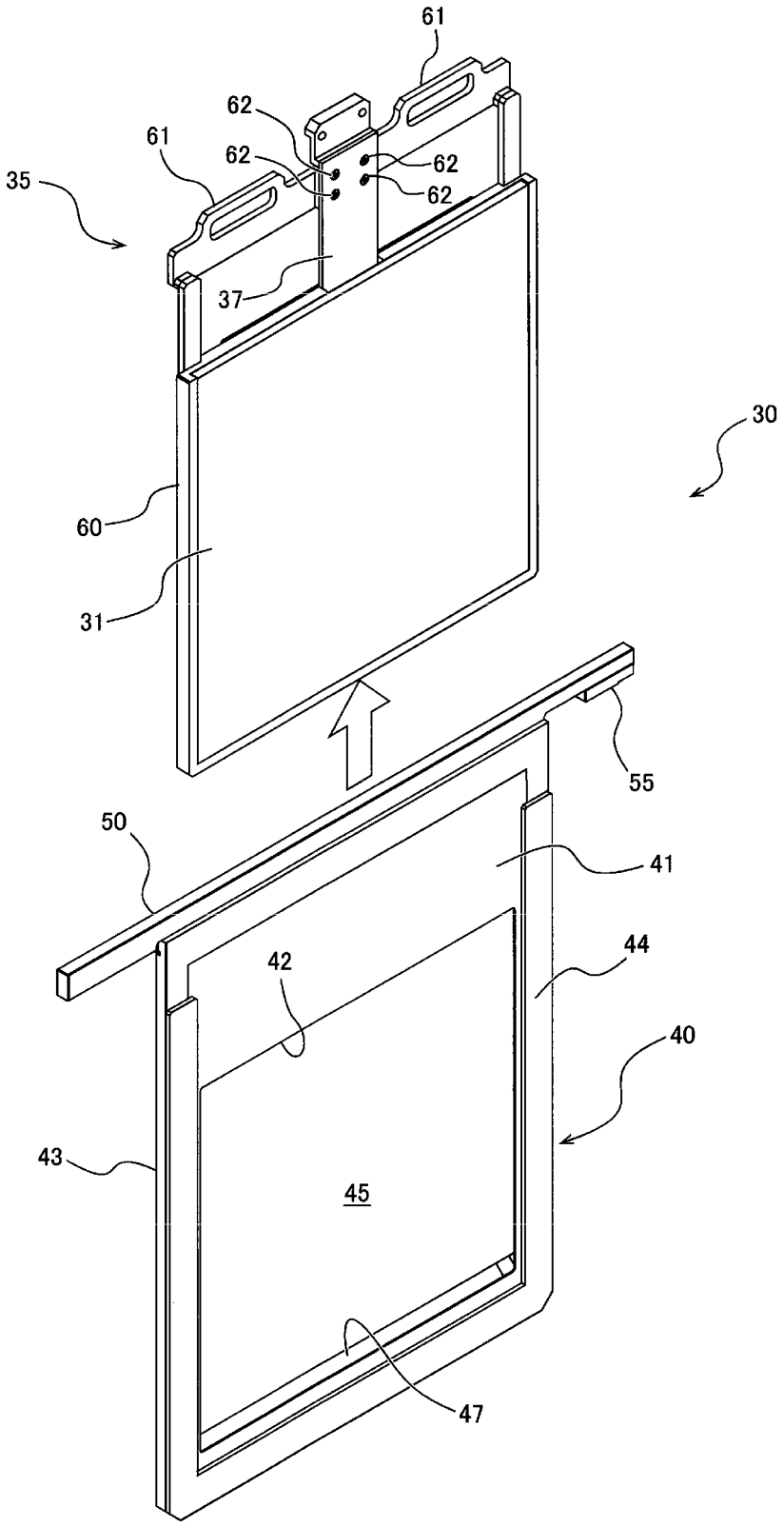
FIG. 6 is a view showing a state in which an anode structure is removed from an anode holder.

FIG. 6 is a view showing a state in which the anode structure 35 is removed from the anode holder 40. The anode structure 35 can be removed from the anode holder 40 by removing the screws 56 (see FIG. 3) as fasteners from the feeding member 37. A user can grab the handles 61 of the anode cartridge 60 and can pull up the anode structure 35 from the plating tank 10.

The anode support frame 43 has a shape surrounding the anode 31. The anode support frame 43 has a space 45 in which the anode structure 35 is arranged. The space 45 is open toward the front side and the back side of the anode support frame 43. A part of the anode structure 35 is located in the space 45. Specifically, the anode 31 and a part of the anode cartridge 60 are located in the space 45.

Figure 7:
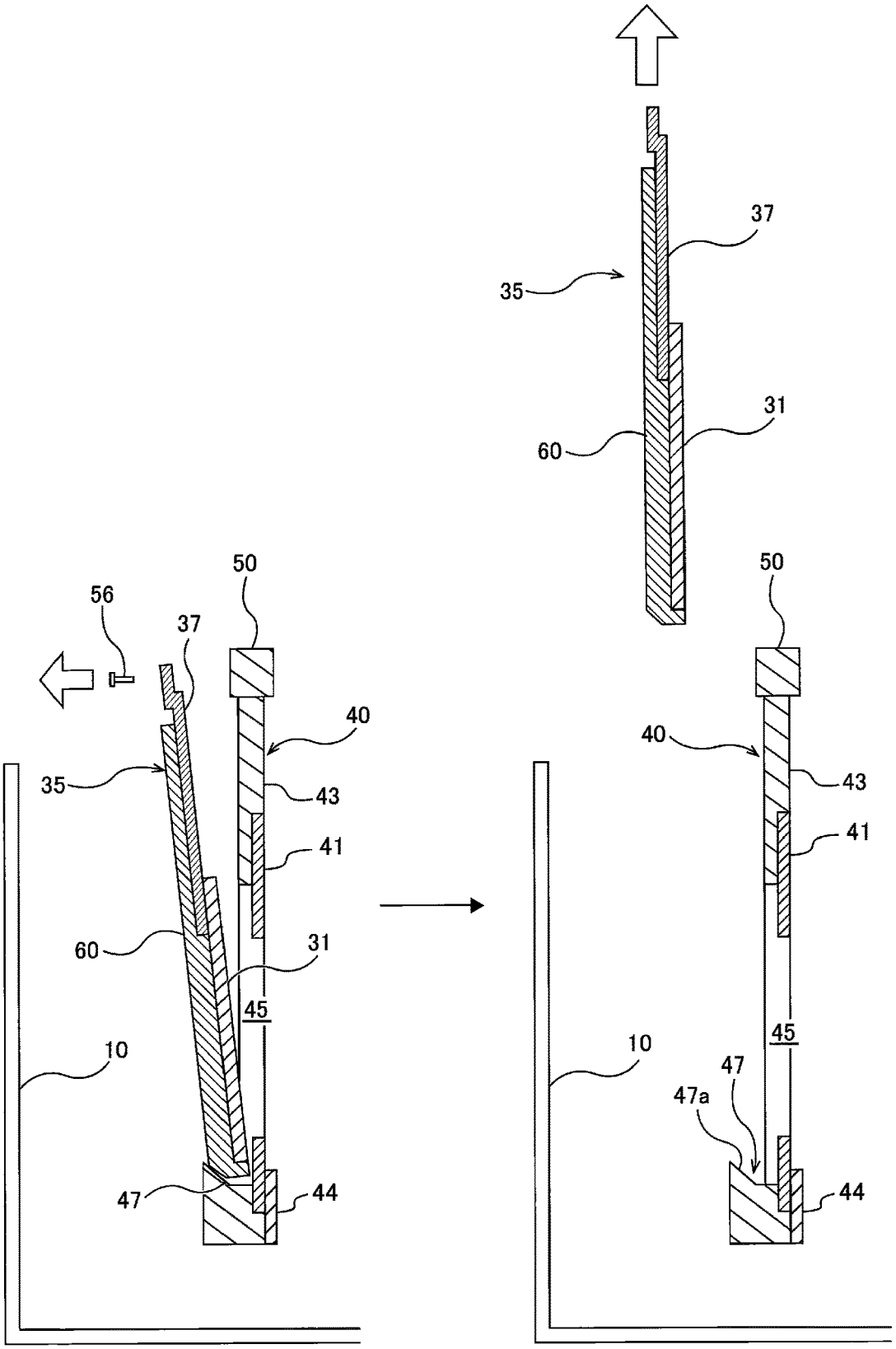
FIG. 7 is a schematic view for explaining an operation of removing the anode structure from the anode holder.

FIG. 7 is a schematic view for explaining an operation of removing the anode structure 35 from the anode holder 40. First, the screws 56 are removed from the conductive bar 50. The anode structure 35 is tilted rearward until an upper portion of the anode 31 is moved outside of the space 45 of the anode holder 40. At this time, the lower end of the anode structure 35 remains inserted into the positioning guide portion 47. Then, the entire anode structure 35 is pulled up, so that the anode structure 35 can be taken out from the plating tank 10 while the anode holder 40 is left in the plating tank 10.

The screws 56 and the conductive bar 50 are located above the plating tank 10 so that the operation of removing the anode structure 35 can be performed outside the plating tank 10. Therefore, by removing the screws 56 from the conductive bar 50, the feeding member 37 can be removed from the conductive bar 50, and the anode structure 35 can be separated from the anode holder 40 and pulled up from the plating tank 10.

The anode 31 is constituted by a thin metal plate. The anode cartridge 60 is constituted by insulating material and has a thin plate shape. Therefore, the anode structure 35 can be configured to be relatively lightweight with respect to the anode holder 40 even when the anode 31 and the anode holder 40 become large in size with the increase in size of the workpiece W. As a result, the anode structure 35 can be easily pulled up from the plating tank 10.

Figure 8:
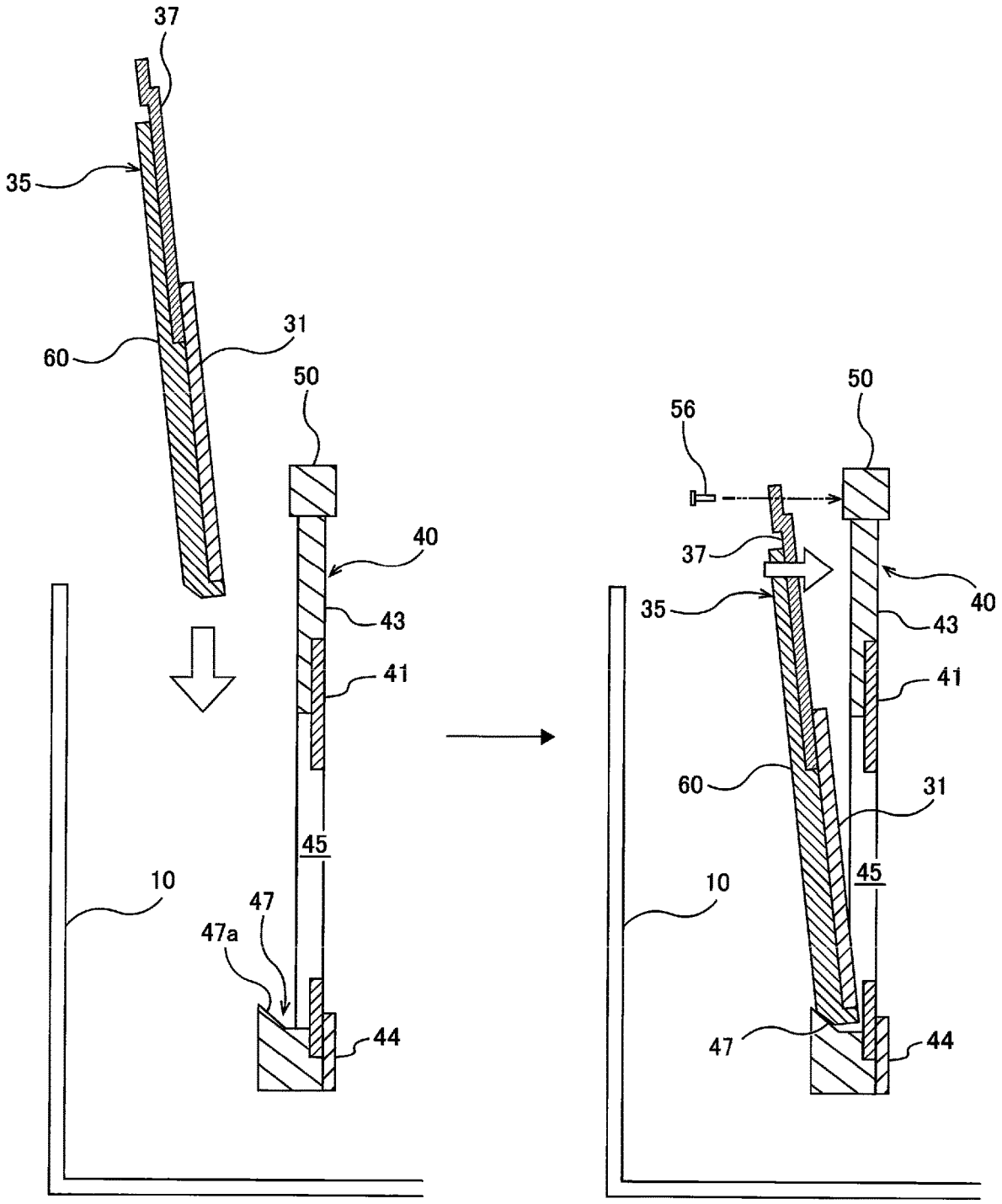
FIG. 8 is a schematic view for explaining an operation of attaching the anode structure to the anode holder.

FIG. 8 is a schematic view for explaining an operation of attaching the anode structure 35 to the anode holder 40. While the anode holder 40 is installed in the plating tank 10, the anode structure 35 is moved toward the inside of the plating tank 10. More specifically, with the entire anode structure 35 slightly inclined, the anode structure 35 is lowered until the lower end of the anode structure 35 is inserted into the positioning guide portion 47. Since the positioning guide portion 47 has the tapered surface 47*a*, the lower end of the anode structure 35 can be easily inserted into the positioning guide portion 47. Then, an upper portion of the anode structure 35 is moved toward the anode holder 40 while the lower end of the anode structure 35 is inserted into the positioning guide portion 47, so that the feeding member 37 is brought into contact with the conductive bar 50 of the anode holder 40. The entire anode 31 is housed in the space 45 of the anode holder 40. Then, the feeding member 37 is fixed to the conductive bar 50 of the anode holder 40 by the screws 56. The anode structure 35 is held on the anode holder 40 by the screws 56 and the positioning guide portion 47.

As shown in FIGS. 4 and 5, the anode support frame 43 includes the side guide portions 46 and the positioning guide portion 47. The position of the anode structure 35 relative to the anode holder 40 is fixed by the side guide portions 46 and the positioning guide portion 47. Therefore, when the anode structure 35 is attached to the anode holder 40, the anode structure 35 can be returned to its original position with high accuracy.

As shown in FIG. 6, the feeding member 37 is detachably fixed to the anode cartridge 60 by a plurality of screws 62 as fasteners. The feeding member 37 extends upward from the anode cartridge 60. The anode 31 and the feeding member 37 can be removed from the anode cartridge 60 by removing the screws 62. In one embodiment, a single screw 62 may be provided as a fastener.

Figure 9:
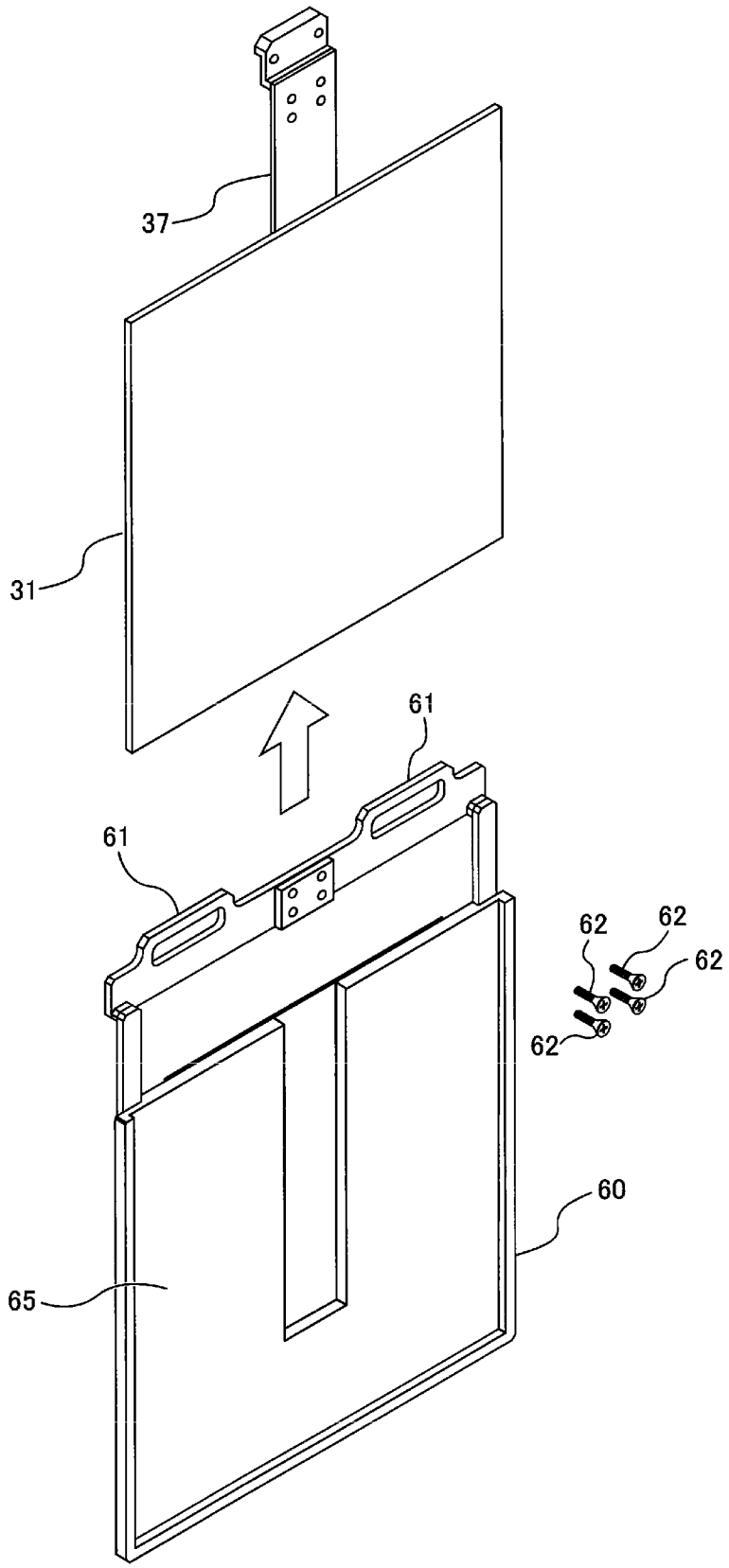
FIG. 9 is a view showing a state in which an anode and a feeding member are removed from an anode cartridge.

FIG. 9 is a view showing a state in which the anode 31 and the feeding member 37 are removed from the anode cartridge 60. The anode 31 is configured to able to be inserted into and removed from the anode cartridge 60. More specifically, the anode cartridge 60 has a recess 65 in its front surface. The recess 65 has a size such that the entire anode 31 is accommodated in the recess 65. The recess 65 has a shape surrounding at least both sides and a lower end of the anode 31.

When the screws 62 are removed, the anode 31 can be slid upward (in a direction in which the feeding member 37 extends). Therefore, the anode 31 can be pulled out of the anode cartridge 60. Similarly, by sliding the anode 31 into the anode cartridge 60, the anode 31 can be accommodated in the recess 65 of the anode cartridge 60.

Figure 10:
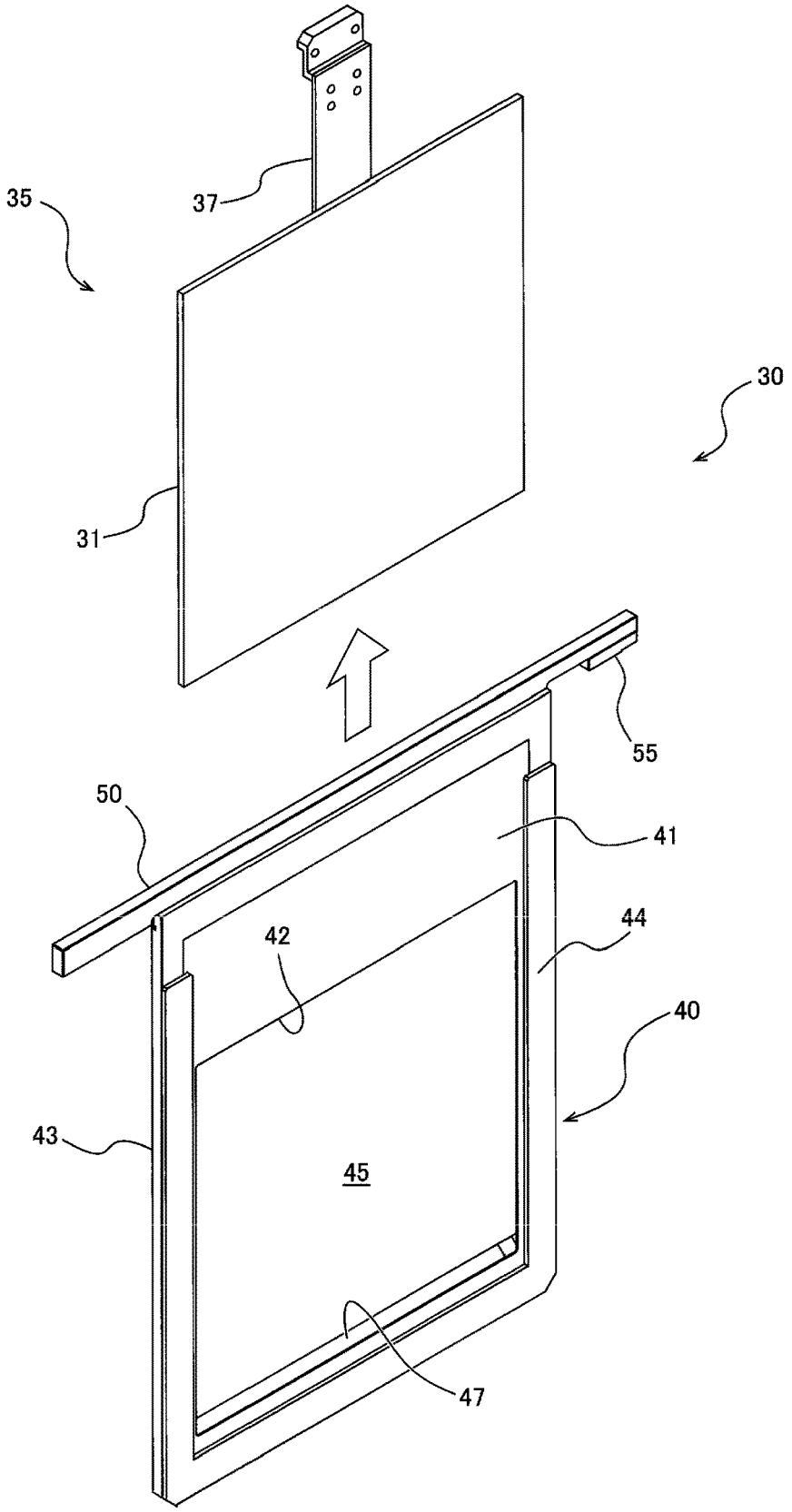
FIG. 10 is a view showing another embodiment of the anode structure.

FIG. 10 is a view showing another embodiment of the anode structure 35. FIG. 10 shows a state in which the anode structure 35 is removed from the anode holder 40. Details of this embodiment, not particularly described here, are the same as those of the embodiments described with reference to FIGS. 1 through 8, and therefore duplicate descriptions thereof will be omitted. The anode structure 35 of this embodiment differs from the embodiments described with reference to FIGS. 1 through 8 in that it does not include the anode cartridge 60. The lower end of the anode 31 is inserted into the positioning guide portion 47. In this embodiment, the anode structure 35 can be configured to be more lightweight.

Figure 11:
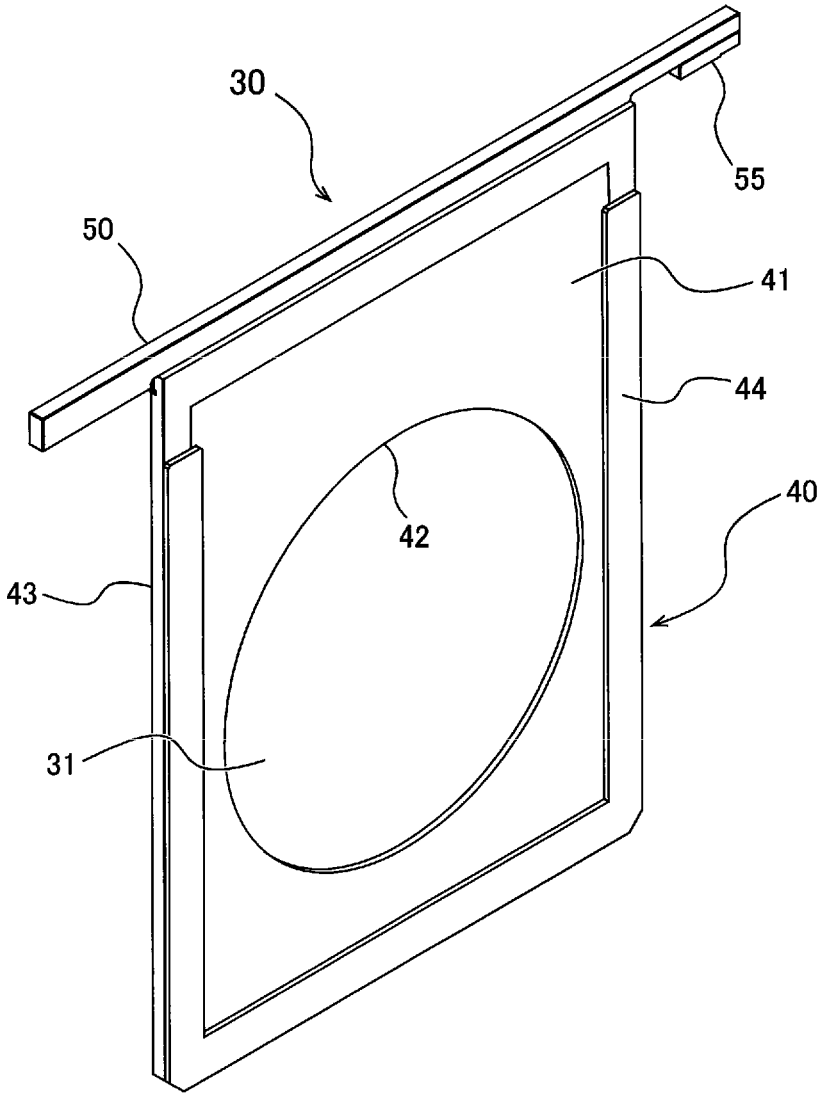
FIG. 11 is a front perspective view showing still another embodiment of the anode assembly.
Figure 12:
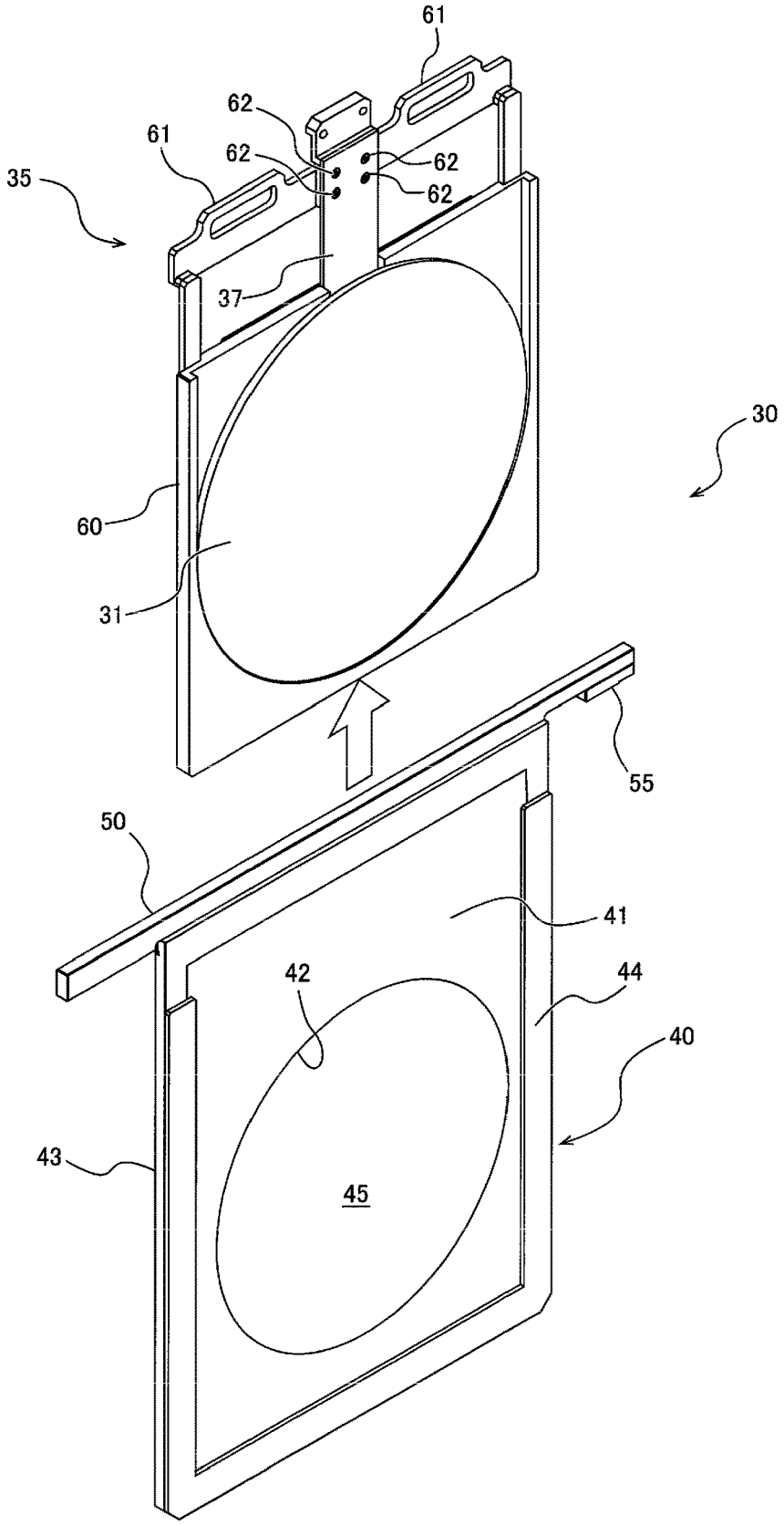
FIG.12 is a view showing a state in which the anode structure is removed from the anode holder.
Figure 13:
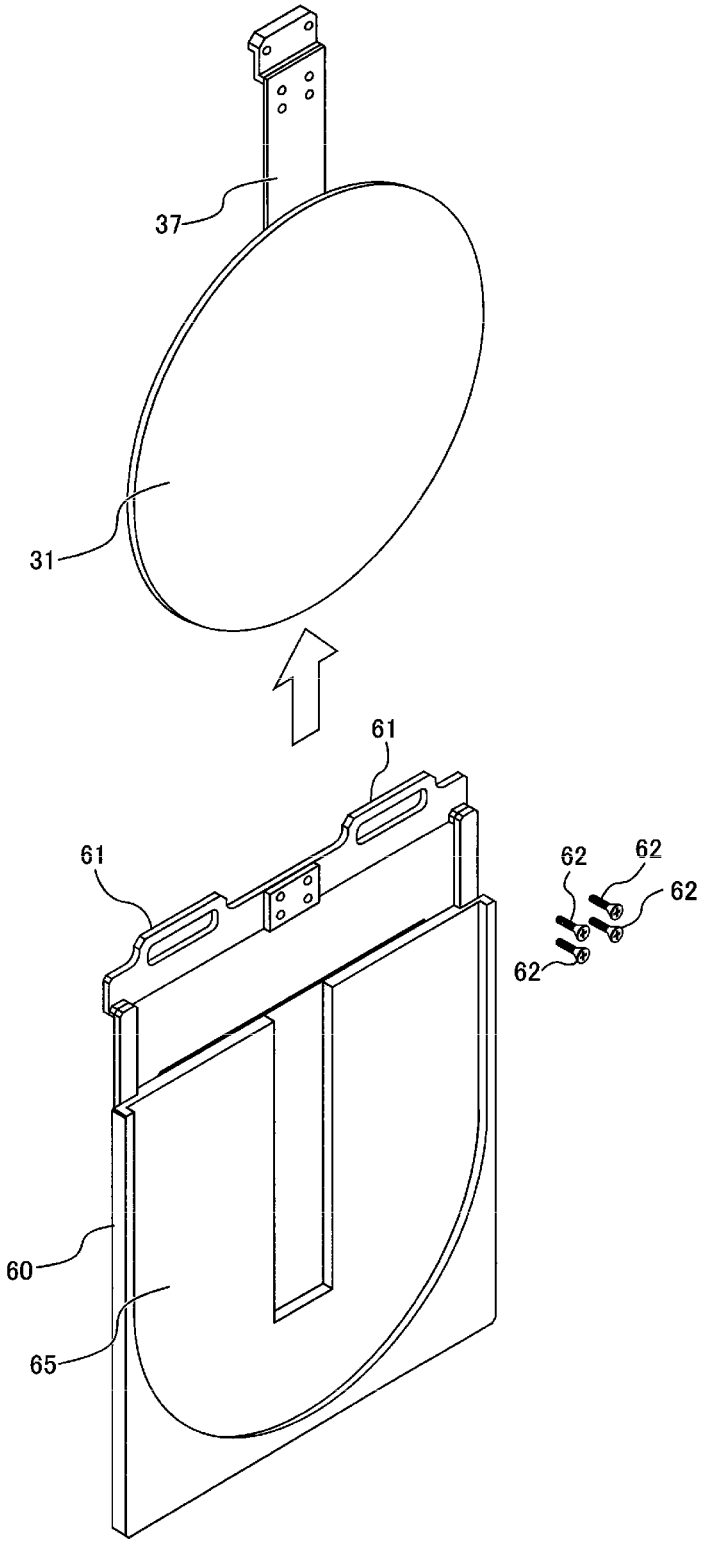
FIG. 13 is a view showing a state in which the anode and the feeding member are removed from the anode cartridge.

FIGS. 11 through 13 are schematic views showing still another embodiment of the anode assembly 30. Details of this embodiment, not particularly described here, are the same as those of the embodiments described with reference to FIGS. 1 through 9, and therefore duplicate descriptions thereof will be omitted. In the embodiments described with reference to FIGS. 1 through 9, the anode 31 has a quadrangular shape, while the anode 31 of this embodiment has a circular shape, and the opening 42 of the mask 41 also has a circular shape. In this embodiment, a circular wafer or the like may be used as the workpiece W to be plated. The embodiment described with reference to FIG. 10 can also be applied to this embodiment shown in FIGS. 11 through 13.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. An anode assembly configured to be vertically positioned in a plating tank, comprising:

an anode structure; and an anode holder configured to hold the anode structure, the anode structure being removably held by the anode holder, wherein the anode structure includes:

an anode; and a feeding member extending upward from the anode, the feeding member being made of metal, the anode holder includes:

an anode support frame having a space in which the anode structure is arranged;

a conductive bar fixed to an upper end of the anode support frame and extending laterally from the anode support frame; and a feeding electrode attached to an end of the conductive bar, the feeding electrode being electrically connected to a plating power supply, one end of the feeding member is fixed to the anode, and an other end of the feeding member is detachably fixed to the conductive bar by a fastener, the anode support frame has a positioning guide portion into which a lower end of the anode structure is inserted, and the anode structure is configured to be able to be separated from the anode holder and be pulled up from the anode holder in the plating tank when the feeding member is detached from the conductive bar.

2. The anode assembly according to claim 1, wherein the anode support frame includes a side guide portion extending along a side of the anode structure.

3. The anode assembly according to claim 1, wherein the anode support frame is made of insulating material.

4. The anode assembly according to claim 1, wherein the positioning guide portion has a tapered surface inclined obliquely downward toward a front of the anode support frame.

5. The anode assembly according to claim 1, wherein the anode structure further includes an anode cartridge configured to cover a back surface of the anode and support the anode.

6. The anode assembly according to claim 5, wherein the anode cartridge is made of insulating material.

7. The anode assembly according to claim 1, wherein the anode holder further includes a mask fixed to the anode support frame, and the mask has an opening located in front of the anode.

8. The anode assembly according to claim 7, wherein the anode has a quadrangular shape, and the opening has a quadrangular shape.

* * * * *